United States Patent [19]

Dischinger

[11] 4,027,371

[45] June 7, 1977

[54] DEVICE FOR THE INSERTION OF AN INTERMEDIATE MEMBER BETWEEN TWO CROSSING STRINGS OF A TENNIS RACQUET

[75] Inventor: Gebhard Dischinger, Wolfenweiler, Germany

[73] Assignees: Babolat-Maillot-Witt, Lyon, France; Lipa Lizenz-und Patentverwertungs-ansalt, Vaduz, Liechtenstein

[22] Filed: May 12, 1976

[21] Appl. No.: 686,225

[30] Foreign Application Priority Data

May 16, 1975 Germany ..... 2521855

[52] U.S. Cl. ..... 29/811; 29/816; 29/239; 81/3R

[51] Int. Cl.[2] ..... B23Q 7/10

[58] Field of Search ..... 29/200 H, 212 R, 212 D, 29/239, 270; 81/3 R; 221/173, 265, 289

[56] References Cited

UNITED STATES PATENTS

| | | | |
|---|---|---|---|
| 1,250,741 | 12/1917 | Wickham | 29/212 R |
| 3,101,477 | 8/1963 | Leniz | 221/268 X |
| 3,174,723 | 3/1965 | McGuire | 29/200 H |
| 3,425,114 | 2/1969 | Fellenzer, Jr. | 29/239 X |
| 3,965,776 | 6/1976 | Wolstenholme | 81/3 R |

*Primary Examiner*—Victor A. DiPalma

[57] ABSTRACT

A device for the insertion of an intermediate member between two crossing strings of a tennis racquet, wherein each intermediate member is a guidance member having two pairs of projections partially encompassing crossing strings, and disposed at right angles to one another, the device including a frame having a handle, and storage means for receiving the intermediate members, the front end of the device having disposed thereon fork-shaped prongs for separating the crossing strings.

25 Claims, 23 Drawing Figures

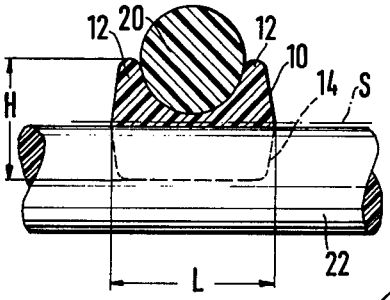
FIG. 2
FIG. 1
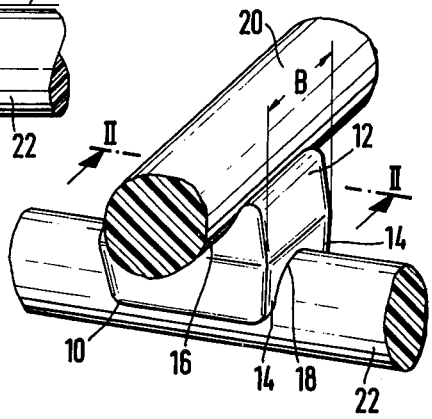
FIG. 3
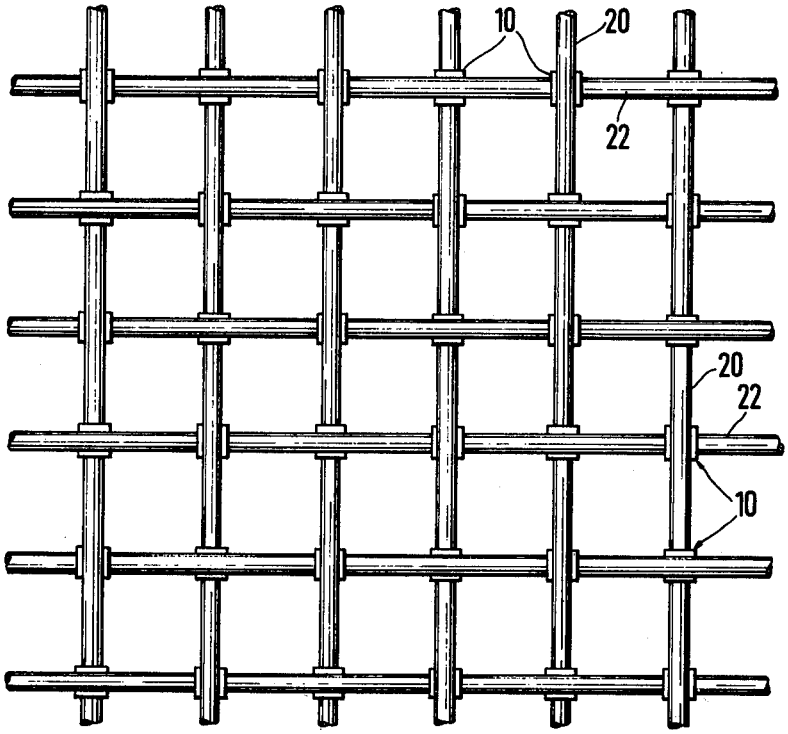

FIG. 9
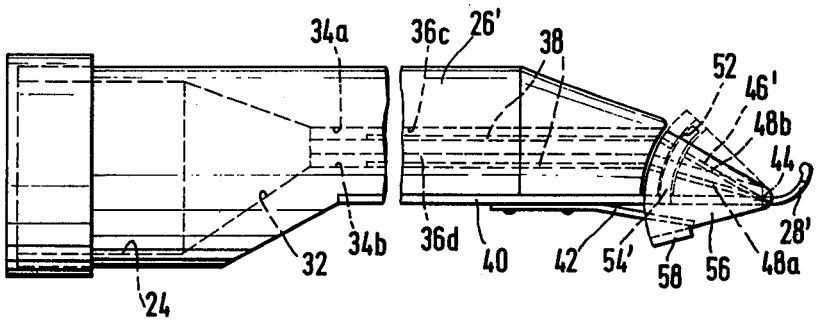
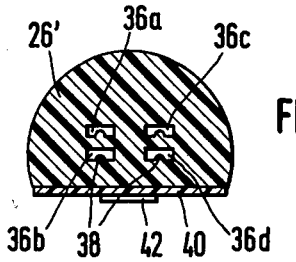
FIG. 11
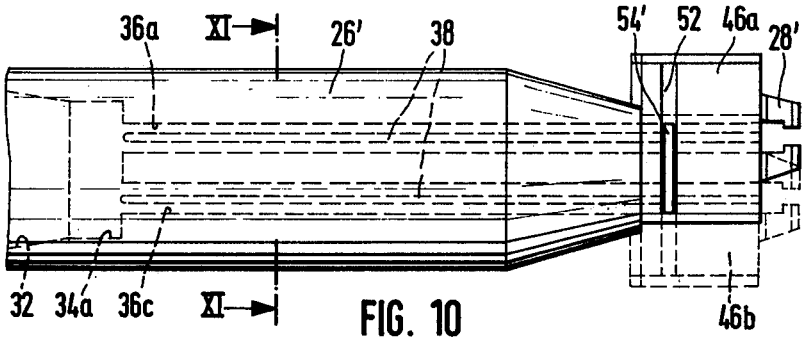
FIG. 10

FIG. 12
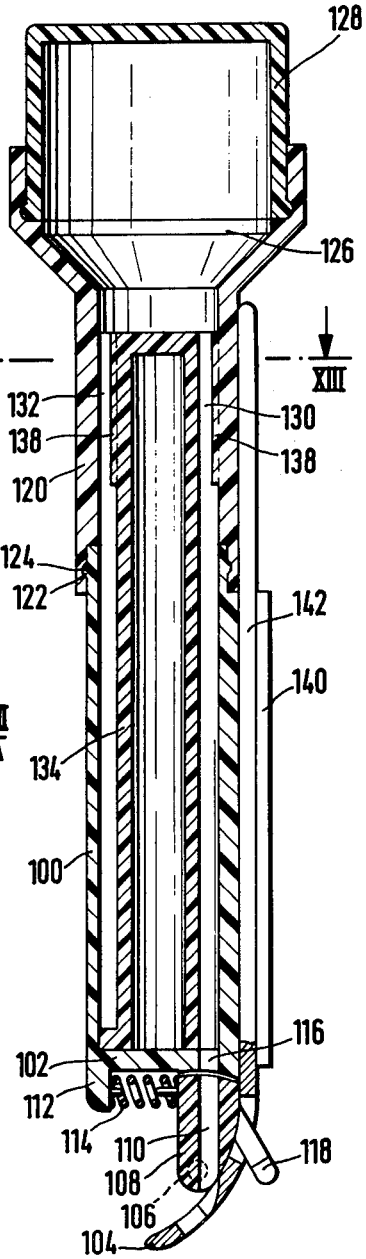
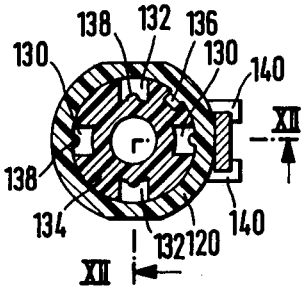
FIG. 13

DEVICE FOR THE INSERTION OF AN INTERMEDIATE MEMBER BETWEEN TWO CROSSING STRINGS OF A TENNIS RACQUET

BACKGROUND OF THE INVENTION

1. Field of the Invention

The present invention relates to a device for insertion of crossing members between respective pairs of strings of a tennis racquet crossing one another.

2. Description of the Prior Art

In order to particularly reduce the wear and tear on strings of a tennis racquet at their respective crossing points, it is known to use inserts between crossing strings. It is further known to separate the crossing strings for insertion of the intermediate members by means of a device of the previously mentioned type. The intermediate members which may, for example, be stored in storage means disposed in a handle of the device, must be inserted manually into the string crossover region. This is extremely hard and time consuming.

OBJECTS OF THE INVENTION

It is therefore an object of the invention to devise an apparatus which permits partially automatic insertion of the intermediate members into the crossing regions, without the necessity of correctly positioning by hand each individual intermediate member between crossing strings.

SUMMARY OF THE INVENTION

The aforesaid object is achieved in a device of the aforesaid kind, according to the invention, by the storage means being connected to, or in communication with a location between the prongs, through a positioning device for the intermediate members and through a guidance channel, and by a supply member being pivotably disposed on the frame of the device, the last segment of the guidance channel bordering the prongs proceeding therethrough, the supply member being formed with a bore or opening crossing the guidance channel, a locking member or handle rigid with the frame of the device being engageable in the bore.

The intermediate members stored in the supply storage means are fed or supplied to a location between the prongs of the device, according to the invention, which corresponds to the crossing location of the strings separated by the device. The crossing members are supplied in this manner automatically or in a self-actuating fashion from the supply storage means to the insertion location. The positioning device causes the intermediate members to be supplied to the guidance channel and therefore to the insertion location in a position suitable for their insertion between the strings. The supply member additionally singles out individual intermediate members, so that only one intermediate member is supplied at a time to the crossing location.

A respective intermediate member is therefore fed automatically to the crossing location of the strings in the correct position upon separation of the crossing strings by the device, according to the present invention.

Since the intermediate members are continuously supplied from the supply storage means, the device permits a rapid and continuous insertion of the intermediate members into respective crossing strings of a tennis racquet.

Since only those intermediate members can be fed or inserted into the guidance channel, which have the correct position for insertion into the crossing location, the supply of the intermediate members may be interrupted, if an adequate number of correctly positioned intermediate members does not enter the quidance channel. To prevent an interruption of this kind, a plurality of two or more guidance channels may be disposed parallel to one another in a further development of the invention. The supply member and the prongs can thereby be jointly displaced, so that they may be coupled successively to the individual respective guidance channels. If a correctly positioned intermediate member is not available in the guidance channel coupled to the supply member, then the latter can be shifted together with the prongs to the next guidance channel, in which there is available a correctly positioned intermediate member to a great degree of probability.

Only a single guidance channel aligned with the guidance channel of the supply member is provided in another version of the invention, but a gripping portion rotatable with respect to the frame of the device is provided, which contains the supply storage means for the intermediate members. This rotatable gripping portion includes the positioning device and additionally a plurality of sorting channels distributed on the periphery of, and parallel to the axis of the device. The sorting channels can be successively aligned with the guidance channel by rotation of the gripping portion. All sorting channels can therefore be filled at a time with correctly positioned intermediate members and successively aligned with the guidance channel by rotation of the gripping portion, so that the positioning members disposed in the respective sorting channels are fed to the supply member and may be inserted into the crossing locations.

In order not to delay filling of the sorting channels with correctly positioned intermediate members by incorrectly positioned intermediate members blocking and sorting channels, several versions of this implementation form of the invention are feasible or possible.

It is possible, for example, to provide sorting channels for incorrectly positioned intermediate members, which preferably alternate with sorting channels for correctly positioned intermediate members. The incorrectly positioned intermediate members enter into these additional sorting channels and cannot therefore block the sorting channel for the correctly positioned intermediate members.

It is alternately possible to let both the correctly positioned and the incorrectly positioned intermediate members enter these channels, and to separate the correctly positioned from the incorrectly positioned intermediate members by a switching segment.

The incorrectly positioned intermediate members are appropriately resupplied in this implementation version of the device, according to the invention, to the supply storage means. It is alternately possible, to provide for a turning segment for incorrectly positioned intermediate members in the sorting channels, which rotates intermediate members into their correct position, so that they can be supplied via the guidance channel to the supply member.

Another version of the invention is finally feasible, in which the incorrectly positioned intermediate members are turned or rotated by a rotating mechanism in the supply-storage means until they assume their correct position and can enter the sorting channels for the correctly positioned intermediate members.

Additional features and advantages of the invention are further illustrated in the drawing according to the various versions shown in the figures of the drawings.

FIG. 1 shows a perspective view of a crossing location of two strings of a tennis racquet with an interposed intermediate member;

FIG. 2 shows a section along the line II—II of FIG. 1;

FIG. 3 shows a plan view of a segment of a tennis racquet with intermediate members inserted at all crossing locations;

FIG. 9 shows a side view of a second version of the device;

FIG. 10 shows a plan view of a front portion of the device disposed near the prongs, and shown in FIG. 9;

FIG. 11 shows a cross-section along the line XI—XI of FIG. 10;

FIG. 12 shows a longitudinal section of a third implementation version of the device;

FIG. 13 shows a cross-section along the line XIII—XIII of FIG. 12;

DESCRIPTION OF THE PREFERRED EMBODIMENTS

Figure 4:
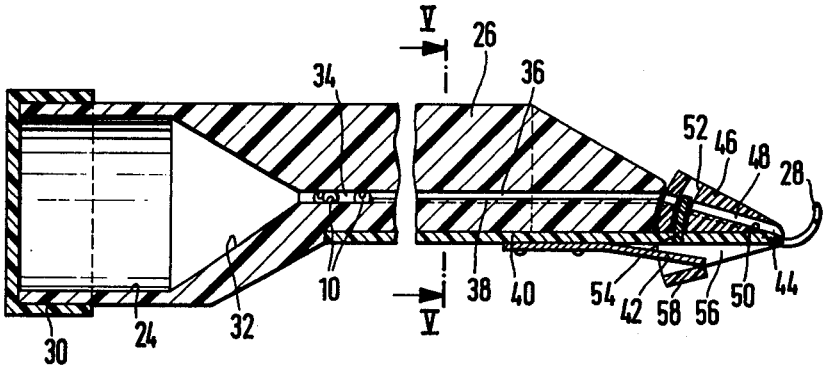
FIG. 4 shows a longitudinal cross-section of a first version of the device.
Figure 5:
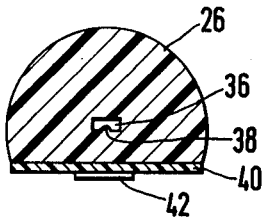
FIG. 5 shows a section along the line V—V of FIG. 4.
Figure 6:
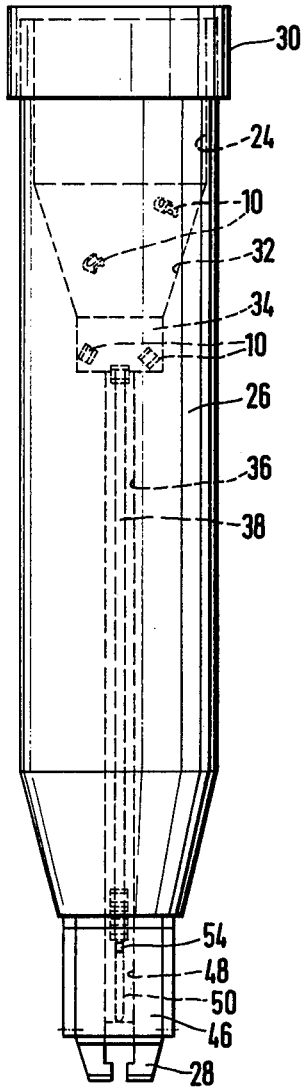
FIG. 6 shows a plan view of the version of the device shown in FIGS. 4 and 5.

The device shown in the drawing serves for the insertion of intermediate members and is fashioned as a guidance cross-piece, as shown in FIG. 1 to 3. These intermediate members 10 include two pairs of projecting members 12 and 14, each pair forming ridges 16 and 18, respectively, for receiving strings 20 and 22, respectively, at the crossing location of the strings. These intermediate members 10 consist preferably of a substantially friction free, self-lubricating plastic synthetic material, and prevent wear and tear of the strings at the crossing locations, at the same time insuring a mutually free displacbility of the strings.

The height H of the intermediate at right angles to their insertion plane S, the latter being parallel to the plane of the strings of a tennis racquet when the intermediate members are inserted, is somewhat smaller than their length L, their width W extending parallel to the insertion plane S.

FIG. 3 shows how the intermediate members 10 are inserted at the individual crossing locations of the strings 20 and 22.

A first version of the device, according to the invention is shown in FIGS. 4 to 8. The device consists of a frame for the device, rigid per se, which carries thereon a supply storage means 24 for the intermediate members, a center part formed as a gripping handle, and two bent, fork-like prongs 28 on the front end for separation of two strings on the crossing location. The supply-storage means 24 is closable by a cover 30 insertable thereonto. The supply-storage means 24 disposed on the rear end of the device narrows into a funnel-shaped prepositioning region, which consists of a first segment 32 which narrows in one dimension up until approximately the height H of the intermediate members, and narrows in a corresponding vertical dimension considerably less, and of a segment 34 which remains uniform in two dimensions.

The funnel-shaped segment 32 may narrow also only in the manner shown in FIG. 4 in one dimension up until the shaft-shaped segment 34, having approximately the height H, while the walls thereof are parallel with a direction perpendicular to the height H. The illustrated implementation version is, however, preferred, for an improved insertion into the subsequent guidance channel 36.

The intermediate members 10 arriving from the supply-storing means 24 in the shaft-shaped segment 34 of the prepositioning region via the funnel-shaped segment 32 are disposed parallel to one another at their respective insertion planes S, but are otherwise arbitrarily positioned about an axis of rotation disposed at right angles to the insertion plane. A guidance rail 18 engaging a respective channel 16 or 18 of the intermediate members, and disposed in the guidance channel 36 ensures that the intermediate members 10 may only enter the guidance channel 36 in a certain spatial disposition seen from FIG. 4.

A plate 40 is rigidly disposed on the lower side of the handle 26, which carries the prongs 28, as well as a leaf spring 42 sloping downwardly on the front end. A supply member 46 is pivotable about an axis of rotation 44 in the vicinity of the prongs 28, and is disposed on the front end of the plate 40; the supply member is formed with a segment of a guidance channel 48 having a guide rail 50, as well as being formed with an arcuate segment or bore 52 disposed approximately at right angles to the latter. A locking member or handle 54 engages in a slot 52 from below, the locking member 54 being attached to the plate 40 and having the shape of an arc corresponding to the arcuate slot 52. The supply member 46 includes a portion 56 sloping downwardly from the frame of the device, i.e. from the plate 40, which engages a bow-shaped member 58 disposed therebelow at the end of the leaf spring and extending in a direction transverse to the part 56.

Figure 7:
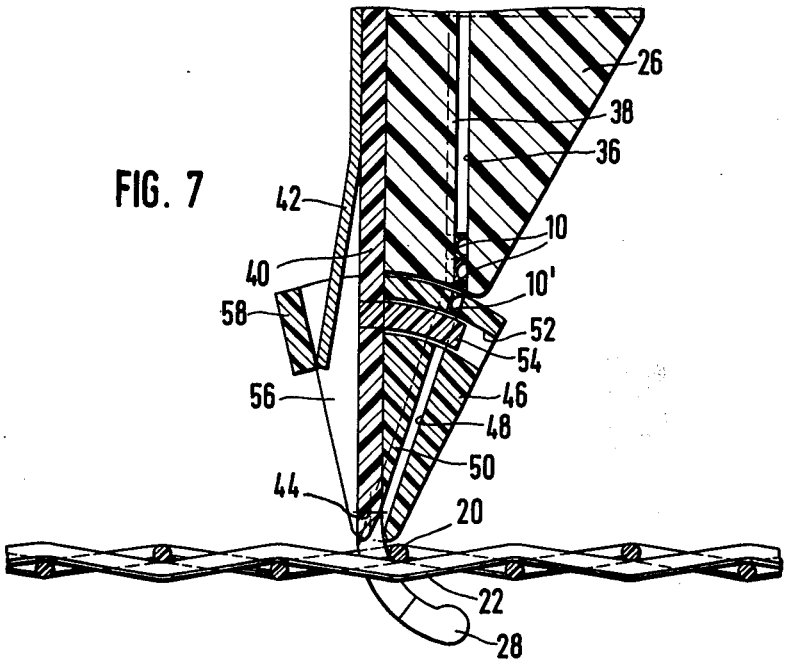
FIGS. 7 and 8 show the end point of the device encompassing the prongs and the supply member in two operating positions, i.e. at the insertion into a crossing location and during tensioning of the strings in an enlarged longitudinal section.
Figure 8:
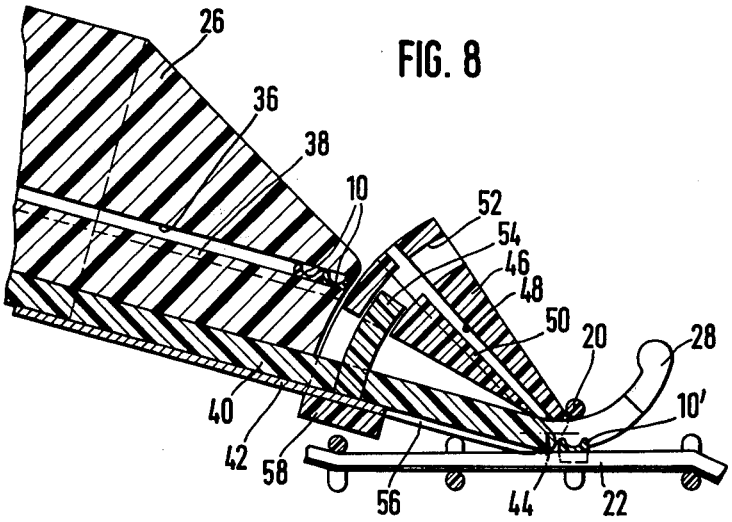

The supply member 46 is normally held by the leaf spring 42 in a first position illustrated in FIGS. 4 and 7, in which position the locking member 54 engages in the slot 52 to an extent enabling the guidance channel segment 48 of the supply member to be locked by the locking member. The portion of the guidance channel segment 48 disposed ahead of the locking member 54, or above the locking member, as shown in FIG. 7, correspond approximately to the length L of an intermediate member 10. An intermediate member 10' can therefore always enter the supply member 46 in the first position thereof upon use of the device at a crossing location between the strings 20 and 22. Subsequently the device is pressed downwards into an inclined position seen from FIG. 8, while the prongs 28 extend below the string 20, and lift the latter slightly from the string 22. During this separation of the string-crossing location the lower placed portion 56 of the supply member 46 simultaneously contacts the other strings of the tennis recquet. This causes the supply member 46 to be pressed upwards against the force of the spring 42, as illustrated in FIG. 8. This causes the locking member 54 in the slot 52 to be displaced downwards until the guidance channel segment 48 is released, for the intermediate member 10' disposed in the supply member 48 to be able to guide in a downwards sloping manner forward into the separated crossing location. The inermediate member 10' is placed with its channel or groove 18 onto the lower string 22, as shown in FIG. 8, and is subsequently clamped into the vertical position shown in FIG. 7 between the two strings, whereby the upper string 20 is placed into the upper channel or groove 16, as seen from FIG. 1. By removing the device from the crossing or cross-over location, the next intermediate member 10 can therefore enter the supply member 46 in a manner shown in FIG. 7, and the insertion process for the next intermediate member can therefore start immediately.

Since one cannot exclude the possibility that some intermediate members 10 may jam either on entering the shaft-shaped segment 34 of the prepositioning region, or upon entering the guidance channel 36 in the gripping handle 26, so that another intermediate member can only arrive at the supply member 46 upon considerable shaking of the whole device, four guidance channel segments **36*a*, 36*b*, 36*c* and 36*d* are provided in the handle 26 in a version of the device, according to the invention, illustrated in FIGS. 9 to 11. All guidance channel segments communicate with the same supply-storage means 24 and the funnel-shaped segment 32 of the prepositioning region adjacent thereto. Two adjacently disposed guidance channel segments 36*a* and 36*c* on one hand, and 36*b* and 36*d* on the other hand, are coupled to a joint shaft-shaped segment 34*a* or 34*b*, respectively, so that in this implementation version two prepositioning regions disposed above one another are provided with a common funnel-shaped segment 32. Each of the four guidance channel segments in the handel 26' includes, as in the aforecited implementation version, a guidance rail 38**. The remaining portions of this version are largely formed in the same manner, i.e. as in the above cited first version. Equal or corresponding parts therefore bear the same reference numerals.

The supply member 46' and the prongs 28' form a joint member in this implementation version, which member is attached to the plate 40 and displaceable in a transverse direction between two positions. The positioning of this member on the plate 40 is not further illustrated, since it is easily understandable to an expert. One position **46*a* is shown in FIG. 10 in full lines, while the other position 46*b*** is shown in dotted lines.

The supply member 46 can be aligned in the position **46*a* with the two right guidance channel segments 36*c* and 36*d*, while it can be aligned in the position 46*b* with the left guidance channel segments 36*a* and 36*b*. The slot 52' extends in this implementation version transversely through the supply member so that the locking member 54', also extending transversely from the left channel 36*a* and 36*b* up to the right channels 36*c* and 36*d*, can also slide without any hindrance through the slot 52'. The guidance channel segment within the supply member 46' can be brought into a first position 48*a* at the first position of the supply member shown in FIG. 9 in full lines, in which position it is aligned with one of the lower guidance channel segments 36*b* or 36*d*. In a non-illustrated second position of the supply member 46', which corresponds to the position shown in FIG. 8 for the first implementation version, the guidance channel segment in the supply member is released, and the intermediate member being detained by the locking member or handle 54' can glide into the separated crossing or cross-over position. A third position 48*b* of the guidance channel segment is exceeded upon the latter being pivoted from the first position 48*a* into a non-illustrated second position with a released guidance channel segment, the guidance channel segment being aligned in the third position with the upper guidance channel segments 36*a* and 36*b* of the handle. If no intermediate member is present in the guidance channel segment 48*a* or 48*b* upon this crossing, then an intermediate member may enter the upper guidance channels following this crossing and is subsequently released upon the fully upwardly pressed supply member 46' reaching the second position in order to slide into the cross-over location. In order for the supply member 46' to snap into the first, second and third position, as well as for snapping into the displacement positions 46*a* and 46*b* illustrated in FIG. 10, snap-in means known to the expert can be provided. The supply member 46'** can therefore selectively be set to one of the four guidance channel segments in the handle in this implementation, and it is very improbable that an intermediate member is not present in any of the four guidance channel segments.

A third version of the device is shown in FIGS. 12 and 13. This device includes a frame 100, which has the form of a cylindrical tube closed on its forward end 102. Two fork-shaped prongs 104 are disposed on this front end of the frame 100. A supply member 106 is pivotably supported between these prongs on the member 106, a guidance channel 110 being formed in the longitudinal direction of the supply member 108.

The supply member 108 is pressed into the position shown in FIG. 12 by a compression spring 114 disposed between a projection 112 of the frame 100 and the supply member 108, in which position the guidance channel 110 is aligned with the guidance channel 116, the latter being also formed in the front wall 102 of the frame 100. The compression spring 114 substitues in its function for the leaf spring 42 of the device of FIGS. 4 to 8.

As has already been stated in detail in the case of the device of FIGS. 4 to 8, the guidance channel 110 found in the supply member 108 is traversed by a non-illustrated bore, a nonillustrated locking member or handle rigid with the frame 100 engaging therein.

The supply member 108 also includes a member 118 projecting outwardly and disposed between the prongs 104, which acts as support during the separation of the strings, and which turns the supply member 108. The supply member 108 corresponds functionally to the supply member 46 of FIGS. 4 to 8, so that further explanations are not necessary. A handle portion 120 is disposed on the rear end of the tubular frame 100. The grip portion 120 slides rotatably on a bulge 122 formed on the circumference of the frame 100, the bulge 122 projecting elastically into a recess 124 formed on the inner circumference of the handle portion 120. The handle portion 120 widens towards the rear end into a supply-storage means 126, which is closed off by a cover 128, the latter being also formed with a peripheral bulge, and projecting into a corresponding peripheral recess formed in the gripping portion 120.

Sorting channels 130 and 132 emanate from the supply-storage means 126 and are distributed over the periphery of the gripping portion 120, proceeding parallel with the axis towards the front end. The sorting channels 130 and 132 are formed by a tube 134 being inserted concentrically in the handle portion 120, the sorting channels 130 and 132 being formed as longitudinal recesses on the circumference portion of the tube 134. The tube 134 is positively locked to the handle portion 120 by means of a projection 136 of the handle portion 120 engaging a recess within the tube 134. The tube 134 extends beyond the gripping portion 120 and projects into the frame 100 up to the front wall 102 thereof. The tube 134 is slidably in contact on its ouer circumference with the frame 100, so that it can be rotated together with the gripping portion 120 in the frame 100.

The sorting channels include guidance rails 138 bordering the entrance opening for the intermediate members from the supply-storage means 126. The cross-section of these guidance rails corresponds to, or meets with the channel formed between the projections of the intermediate members, so that the intermediate members can enter a respective sorting channel 130 or 132 only if the pair of projections of the intermediate member is aligned with these guide rails.

As can be seen from FIG. 13, the guide rails 138 are formed in the sorting channels 130 centrally on the outer side of the sorting channel, while they are formed in the channels 132 centrally on the inner side of the sorting channels.

The sorting channels 130 proceed right up to the front wall of the frame 100. If the handle portion 120 and the tube 134 is rotated or turned therewith with respect to the frame 100 in such a way, that one of the sorting channels 130 is aligned with the guidance channel 116 in the front wall 102, then the intermediate members disposed in this sorting channel 130 can be fed to the supply member 108 in the above described manner, and can be inserted into the cross-over regions of the strings by means of this supply member.

Since only those intermediate members can enter the sorting channel 130 which have the outer projection pair aligned in the longitudinal direction of the device, these intermediate members are discharged in their correct position from the supply member 108 at the assembly point between the prongs 104.

The sorting channels 132 are, however, closed on the end thereof facing the front wall 102. The intermediate members entering in the sorting channels 132, which are rotated by 90 degrees with respect to the sorting channels 130, and are therefore incorrectly positioned for assembly, cannot therefore arrive at the guidance channel 116 and be supplied to the supply member 108.

On the other side of the frame 100 there are disposed two longitudinal brackets 140. A metallic reinforcement rail 142 is held by these brackets 140. This rail 142 projects beyond the connected location between the frame 100 and the handle portion 120. The reinforcement rail 142 therefore supports this connective location upon pressing the device downwards for separating the crossed strings. The simple rotation connection consisting of the buldge 122 and the recess 124 is therefore not subjected to any bending moment upon actuation of the device.

The device shown in FIGS. 12 and 13 operates as follows:

The intermediate members are supplied in an unsorted manner into the supply-storage means 126. A slight shaking of the device causes the intermediate members to enter into the sorting channels 130 and 132, until all sorting channels 130 and 132 are filled with correctly and incorrectly positioned intermediate members, respectively. The sorting channels 130 are then aligned successively with the guidance channel 116 by rotation of the gripping portion 120, and the intermediate members disposed in these sorting channels 130 are individually sorted with the aid of the supply member 108, and are inserted in the cross-over regions of the strings. Upon all intermediate members of the sorting channels 130 having been inserted in this manner, the device is reversed, so that the incorrectly positioned intermediate members from the sorting channels 132 fall back into the supply-storage means 126. Subsequently all sorting channels 130 and 132 are again filled by shaking.

Figures 14, 15:
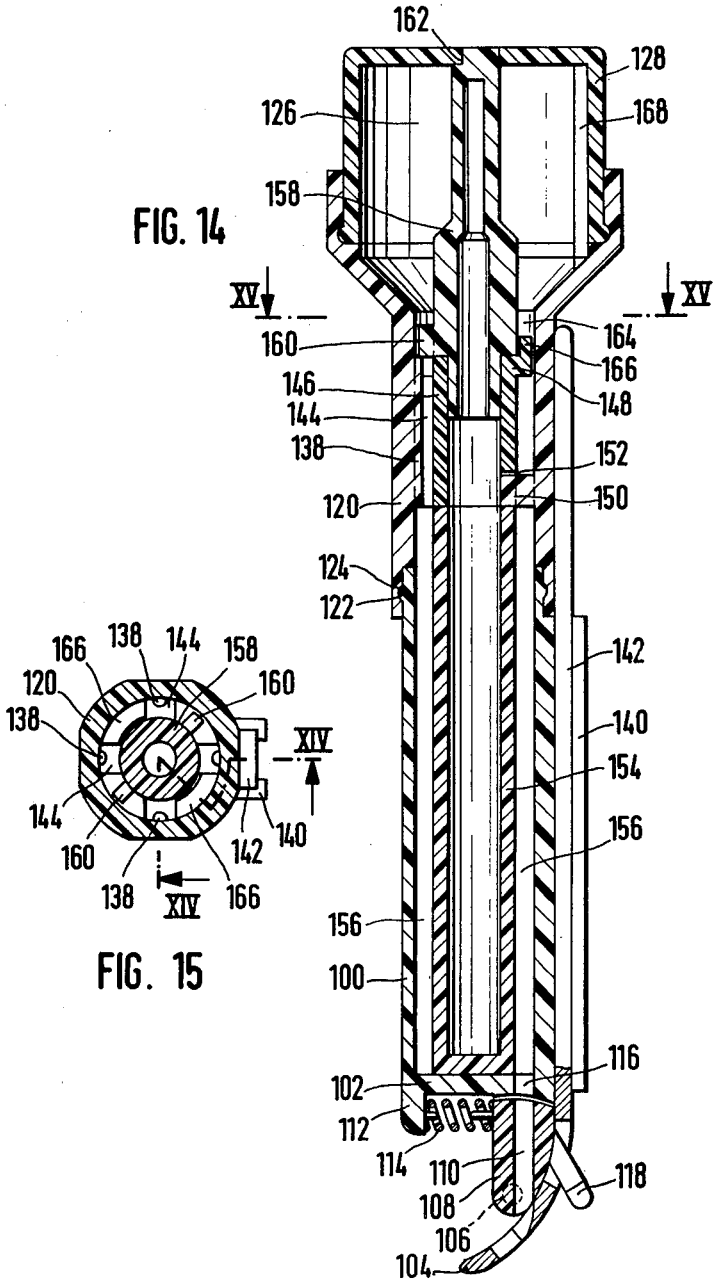
FIG. 14 shows a longitudinal section of a fourth version of the device.
FIG. 15 shows a cross-section along the line XV—XV of FIG. 14.

A fourth implementation example of the device is shown in FIGS. 14 and 15, FIG. 14 being a cross-section along the line XIV—XIV in FIG. 15, and FIG. 15 a cross-section along the line XV—XV in FIG. 14.

The frame 100 and the mechanism of prongs 104 and supply member 108 correspond to the version shown in FIG. 12.

A handle portion 120 is rotatably disposed on the rear end of the frame 100, the gripping portion 120 receiving on the rear end thereof a supply-storage means 126 for intermediate members, the latter means being closed off by a cover 128.

Four sorting channels 144 in the form of recesses are formed on the inner circumferential surface of the hollow cylindrical gripping portion 120, which, as shown in FIG. 15, are disposed in an axial direction and displaced from one another by 90°. A concentric tubular insertion piece 146 closes the sorting channels on their inner respective sides. The insertion member 146 includes an enlarged or widened flange 148, which faces the entrance side of the sorting channels 144. The insertion member 146 may therefore be inserted into the handle portion 120 from the side of the supply-storage means 126. A bulge 150 projecting inwardly from the handle portion 120 therefore engages an axially disposed slit 152 formed in the insertion member 146 and prevents the latter from rotating.

In the flange 148 there are formed openings corresponding in cross-section with the sorting channels 144, so that the intermediate members can enter therethrough into the sorting channels 144. Guidance rails 138 are disposed in the sorting channels 144, which are centrally located at their respective outer sides of the sorting channels 144, so that only correctly positioned intermediate members may enter the sorting channels 144.

An extension member 154 is attached to the hollow insertion member 146 so as to be rotatable therewith, but detachable therefrom; the extension member 154 abuts the insertion member 146 coaxially and projects into the frame 100 up to its upper front wall 102. Axially disposed sorting channels 156 are formed on the peripheral surface of the extension member 154, and are closed off on their external sides by the frame 100, and lead up to the front wall 102 of the frame. Positive locking between the insertion member 146 and the extension member 154 can, for example, be accomplished by a non-illustrated projection of the extension member, which engages in an axial slot of the insertion member 146.

A shaft 158 of the mixing mechanism is concentrically inserted into the hollow cylindrical insertion member 146 and is rotatable therein; the mixing member includes two wings 160 disposed diametrically opposite one another. The shaft 158 is positively locked to the cover 128, which may, for example, be accomplished by a flattening portion 162 of the shaft and a corresponding recess in the cover.

As is shown in FIG. 14, the supply-storage means 126 is narrowed ahead of the entrance openings to the sorting channels 144. This results in the formation of a prepositioning region 164 between the gripping portion 120 and the shaft 158 of the mixing mechanism, the radial width of the latter corresponding to the height H of the intermediate member.

The intermediate members therefore arrive at this prepositioning region aligned in their respective insertion planes at the entry openings of the sorting channels 144.

Upon rotation of the cover 128 with respect to the handle portion 120 the wings 160 of the mixing mechanism brush against the entrance openings of the sorting channels 144 of this prepositioning region or zone 164.

The flanges 148 is formed with two cam-shaped embossed portions 166 disposed next to respective entry openings of the sorting channels 144, the embossed portions projecting into the prepositioning region or zone 164.

The cover 128 includes on its inner circumference a stop 168, which cooperates with a non-illustrated stop on the inner circumference of the handling portion 120, and so limits the rotation of the cover 128 and therefore of the mixing mechanism, that the wings 160 of the mixing mechanism cannot impinge on the cam-shaped reliefs or embossed portions 166.

The device shown in FIGS. 14 and 15 operates in the following manner:

The intermediate members disposed arbitrarily in the supply-storing means 126 slide into the prepositioning region 164 via the funnel-shaped opening. There they are aligned in the prepositioning region 164 along their insertion plane; an assortment of correctly and incorrectly positioned intermediate members has not, however, taken place.

As a result of the rotation of the cover 128 with respect to the handle portion 120, the wings of the mixing mechanism 160 are moved to and fro, sliding the intermediate members disposed in the prepositioning region 164 over the entrance openings of the sorting channels 144 thereby.

The correctly positioned intermediate members may therefore enter respective sorting channels and slowly fill the sorting channels 156.

The incorrectly positioned intermediate members are slid in an upward direction by the wings 160 of the mixing mechanism into the cam-shaped reliefs or embossing portions 166, which causes the intermediate members to tip and to possibly occupy the correct position, so that they may also enter the sorting channels 144. This to-and-fro motion of the mixing mechanism is carried out until all sorting channels are filled with correctly positioned intermediate members.

The sorting channels 156 are successively aligned with the guidance channel 116 by rotating the gripping portion 120, and therefore the extension portion 154, so that the intermediate members disposed in these sorting channels are successively inserted one after another into the tennis racquet strings by means of the supply member 108. When all sorting channels 156 or 144 have been completely emptied, the insertion process is interrupted and the sorting channels are again filled with intermediate members by renewed actuation of the mixing mechanism.

Figure 16:
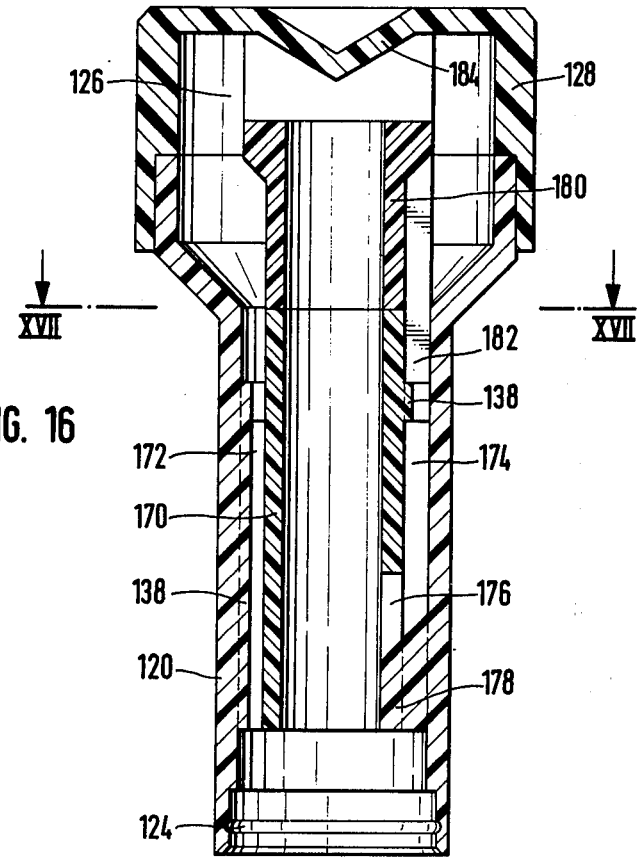
FIG. 16 shows a longitudinal section of the gripping portion of a fifth implementation version of the device.
Figure 17:
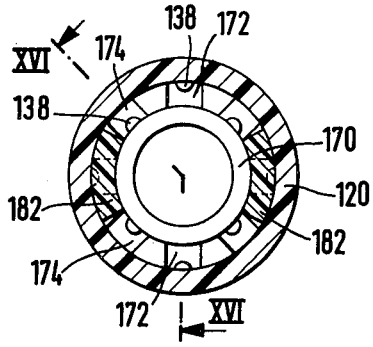
FIG. 17 shows a corss-section along the line XVII—XVII of FIG. 16.

A fifth implementation version of the device is shown in FIGS. 16 and 17. FIG. 16 shows a section along the line XVI—XVI in FIG. 17, and FIG. 16 shows a section along the line XVII—XVII in FIG. 16. The frame 100 and the extension portion 154 disposed therein are not shown in FIG. 16, since those parts correspond with the corresponding parts in FIG. 14. Only those portions will be further explained which differ from the corresponding portion of the device, according to FIG. 14.

Axial sorting channels 172 and 174 are formed in the form of recesses on the inner circumferential plane of the handle portion 120, and are closed off on their respective inner sides by a concentrically inserted and hollow insertion member 170.

The sorting channels 172 are formed on their outer respective sides with a coaxially disposed guide rail 138, the latter ensuring that only correctly positioned intermediate members may enter the sorting channels 172 from the prepositioning region 164. The sorting channels 172 communicate with corresponding sorting channels 156 of the non-illustrated extension portion 154.

The sorting channels 174 do, however, include on their inner side a centrally disposed guide rail 138, so that only incorrectly positioned intermediate members may enter the sorting channels 174. The hollow cylindrical insertion member 170 is formed at the end thereof facing the extension portion 154 with axial slits 176, which coincide with respective sorting channels 174, as is shown in FIG. 16.

Inwardly projecting bulges 178 of the handle portion 120 engage radially in the slits 176, the bulges 178 preventing a rotation of the insertion member 170 with respect to the handle portion 120. As is shown in FIG. 16, these bulges 178 do not, however, fill the slits 176 completely along their respective axial lengths, but permit these slits to be open at the rear end along a certain axial length. The protrusions 178 furthermore slope inwardly downwards at that rear end.

A mixing mechanism is positively locked to the cover 128, which is rotatably disposed on the gripping portion 120, the mixing mechanism consisting of a hollow shaft 180, wings 182 oppositely disposed to one another and attached to the shaft 180, the wings 182 projecting into the prepositioning region 164 and brushing over the entry openings of the sorting channels 172 and 174.

The hollow shaft 180 is not closed up to the cover 128, but is laterally open on its rearward end. The cover 128 is formed with a cone-shaped inwardly projecting bulge 184 disposed opposite the rearward open end of the shaft 180.

The device shown in FIGS. 16 and 17 operates in the following manner:

The arbitrarily oriented intermediate members arrive in the prepositioning region 164 from the supply-storage means 126, and are aligned at their respective insertion planes. The intermediate members are moved by rotation of the mixing mechanism with the aid of the cover 128 over the entry openings of the sorting channels, so that the correctly positioned intermediate members arrive at the sorting channels 172, and subsequently thereto at the sorting channels 156.

The incorrectly positioned intermediate members arrive at the sorting channels 174 and slide therefrom via the sloping bulges 178 through the slots 176 into the inner portion of the hollow cylindrical insertion member 170, so that they fall into the hollow extension member 154 and accumulate at the front end thereof. As soon as the sorting channels 172 and the adjoining sorting channels 156 have been filled with correctly positioned intermediate members, the insertion progress is started and continued until all sorting channels 156 successively brought into alignment with the guidance channel 116 are emptied. The device is then turned over, so that the intermediate members accumulated on the front end of the extension portion 154 fall rearwards through the insertion member 170 and the shaft 180, and are fed back by the cone-shaped bulge 184 laterally into the supply-storage means 126. By rotation of the cover 128 with respect to the gripping portion 122, the sorting channels 172 and 174 are then filled anew with intermediate members.

A modification of the device shown in FIGS. 16 and 17 will now be explained with the aid of FIGS. 18 to 20.

Figure 20:
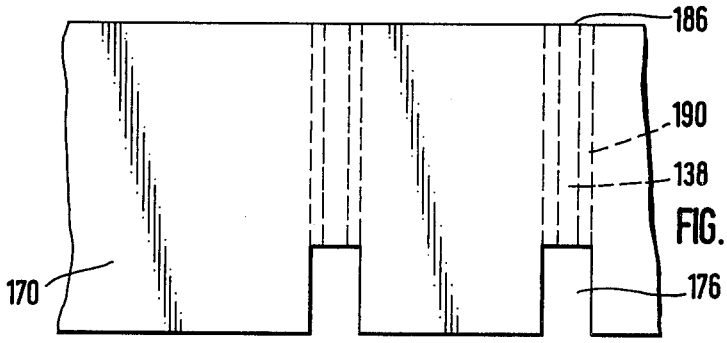
FIG. 19 and 20 show developments or exploded segments of the device of FIG. 18 containing the sorting channels.
Figure 19:
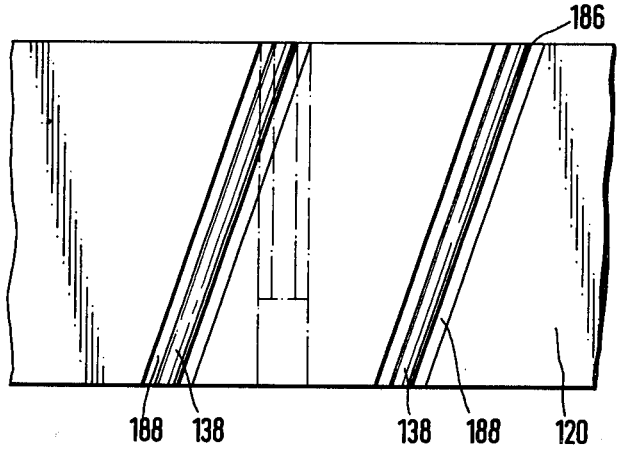
Figure 18:
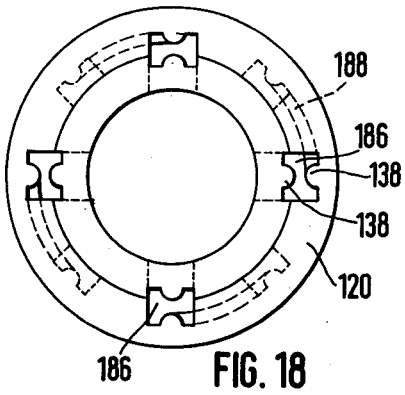
FIG. 18 shows a plan view of entrance openings of the sorting channels of a sixth version of the device.

Since the sixth implementation example differs from the implementation example shown in FIGS. 16 and 17 only by the type of sorting channels, only the progress or course of the sorting channels from their respective entrance opening up to the front end of the gripping portion 120 is illustrated in FIGS. 18 to 20, where the extension member 154 starts. This sixth version coincides in all other portions with the version of FIGS. 16 and 17.

FIG. 18 shows a plan view of the entrance openings of the sorting channels, FIG. 19 shows an exploded development of the inner circumferential surface of the gripping portion, and FIG. 20 shows an exploded development of the inner circumferential surface of the hollow cylindrical insertion member.

As can be seen from FIG. 18, the sorting channels are formed with an entry opening 186, the radial widths thereof corresponding approximately to 1½ the height H of the intermediate members. A centrally disposed guide rail 138 starts on the outside, as well as on the inside of the entry openings 186.

Both correctly positioned as well as incorrectly positioned intermediate members may enter this entry opening 186 as a result of the shape of the latter. The correctly positioned inermediate members slide thereby on the guide rail 138 along the outer side of the entry opening 186, while the incorrectly positioned intermediate members slide along the inner side of the entry opening 186 on the guide rail 138.

As is shown in the exploded development of the inner surface of the gripping portion 120 in FIG. 19, longitudinal sorting channels 188 are formed on the inner surface which start at the entrance openings 186 and proceed in helicoidal fashion to the sorting channels 156 of the non-illustrated extension portion 154. Since the guide rails 138 proceed centrally on the outer side of these sorting channels 188, the correctly positioned intermediate members in the sorting channels 188 are fed to the sorting channels 156.

Longitudinal sorting channels 190 are formed on the outer surfaces of the hollow insertion member 170, which proceed from the entry openings 186 parallel to the axis. In these axially parallel sorting channels 190 there are centrally disposed the guide rails 138 of the inner side of the entry openings 186.

As shown in FIG. 20, wherein the sorting channels 190 formed on the outer surface of the insertion member 170 are shown covered in FIG. 20, these channels proceed towards axial slots 176 formed in the front end of the insertion member 170, the latter cooperating with projections or bulges 178 of the gripping portion 120, as has already been described with the aid of FIG. 16. The incorrectly positioned intermediate members are therefore fed to the sorting channels 190 and enter the inner portion of the insertion member 170 via the slots 176, where they fall into the extension member 154.

The sorting channels 188 and 190 act in this version of the device as a sort of switch which separates the correctly positioned from the incorrectly positioned intermediate members.

In order to clarify this switch action, the course of the sorting channels 190 within the outer surface of the insertion member 170, the latter contacting the inner surface of the gripping portion 120, is shown dotted in FIG. 19.

Figure 21:
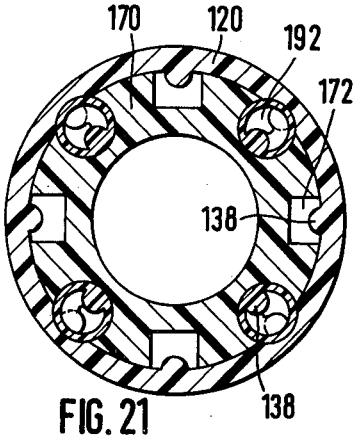
FIG. 21 shows a plan view of the entrance openings of the sorting channel in a seventh version of the device.
Figure 22:
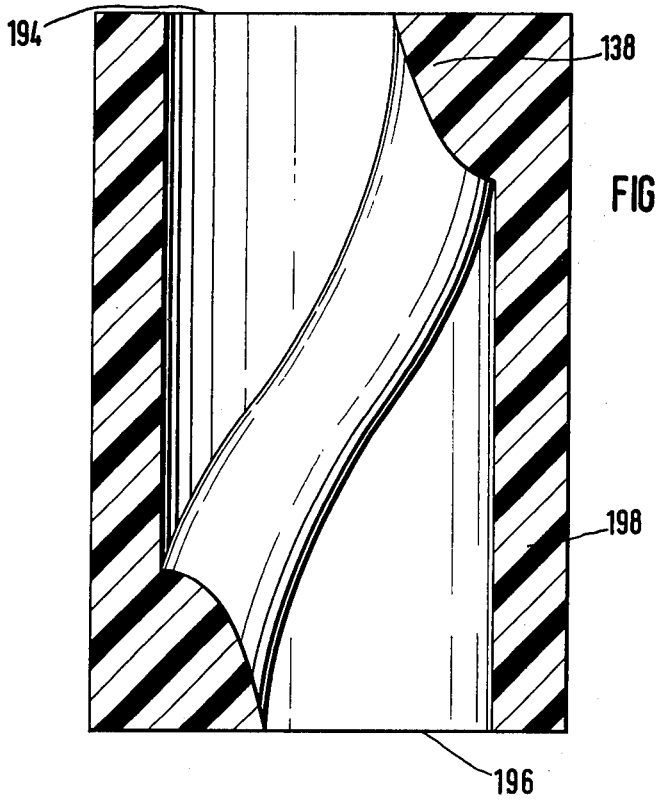
FIG. 22 shows an enlarged longitudinal section of a sleeve according to FIG. 21, containing a sorting channel.
Figure 23:
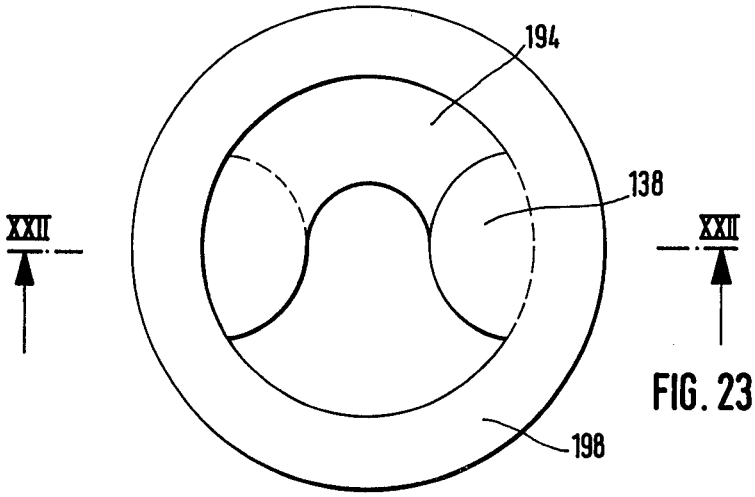
FIG. 23 shows a plan view of the sleeve of FIG. 22.

A further modification of the device is shown in FIGS. 16 and 17, and is further discussed with the aid of FIGS. 21 and 23. Also in FIGS. 21 to 23 there is only illustrated the course of the sorting channels in the gripping portion from the entrance opening of the sorting channels up to the location where the sorting channels on the front end of the gripping portion communicate with the sorting channels 156 of the extension member 154.

As shown in FIG. 21, the sorting channels 172 for the correctly positioned intermediate members coincide with the sorting channels 172 of the version of FIGS. 16 and 17. Only correctly positioned intermediate members enter these sorting channels 172, and are led therefrom to the adjoining sorting channels 156.

The sorting channels 192 for the incorrectly positioned intermediate members are shown in the version of FIGS. 21 to 23 as repositioning segments, in which the incorrectly positioned intermediate members are repositioned to their respective correct positions. Since the intermediate members entering in a wrong position into the sorting channels 192 assume the correct position towards the end of this repositioning segment, the sorting channels 192 also communicate with the sorting channels 156 of the adjoining extension portion 154.

A single sorting channel 192 is illustrated for clarity's sake in an enlarged manner in longitudinal cross-section and plan view, respectively, in FIGS. 22 and 23. The guide rail 138 commences or starts at the entry opening 194 of the sorting channel 192 on the inner side of the sorting channel, and along a central axis thereof, as viewed in the cross-section of FIG. 23, so that only the incorrectly positioned intermediate members may enter into the sorting channel 192.

As can be seen from FIGS. 22 and 23, the guide rail 138 proceeds from the entrance opening 194 in a helicoidal fashion into the sorting channel 192.

The guide rail 138 is disposed in this manner centrally on the outer side of the sorting channel 192 on the front end 196, where the sorting channel 192 communicates with the adjoining sorting channel 156 of the extension portion 154. The intermediate members sliding on the helicoidally-shaped guide rail 138 are therefore turned along the path from the entry opening 194 up to the end 196 of the sorting channel 192 around their axis by 180°, the axis proceeding in parallel with the longitudinal axis of the device, the members being thereby positioned correctly. In order to make the repositioning of the intermediate members feasible, the sorting channels 192 are formed at least in the respective center regions of their respective longitudinal extensions with a circular cross-section. For technical manufacturing reasons, particularly for the manufacture from synthetic plastic material by injection molding, the sorting channels 192 are manufactured as cylindrical bushing 198, which may be inserted into the gripping portion 120, or into the hollow cylindrical insertion member 170. While there has been shown what is considered to be the preferred embodiment of the invention, it will be obvious that modifications may be made which come within the scope of the disclosure of the specification.

What is claimed is:

1. A device for the insertion of a plurality of intermediate members between respective pluralities of cross-over locations of strings of a tennis racket wherein each of the intermediate members in a cross-over guidance member formed with first and second pairs of projecting members disposed at right angles to one another, each of said pairs partly surrounding one of the strings, comprising:

a frame having a handle portion and supply-storage means for the intermediate members, said frame having a front end and two fork-shaped prongs disposed on said front end for separating the crossing strings, including a location between said prongs;

positioning means for positioning the intermediate members;

a guidance channel formed in said frame and having a plurality of segments, said supply-storage means communicating with said location through said positioning means and through said guidance channel;

a supply member pivotably attached to said frame and formed with an opening, and a bore perpendicular to said opening, said opening being the last segment of said guidance channel and bordering said prongs, said bore traversing said guidance channel; and a locking member rigid with said frame and engageable in said bore.

2. A device according to claim 1, further comprising a spring for holding said supply member in a first position, said guidance channel formed in said frame being aligned with the segment opening, and said locking member being engaged in said opening in said first position, and a member projecting outwardly from said frame and pivotable against the spring force into a second position, said locking member being outside of said guidance channel in said second position, the projecting member abutting the non-separated strings upon use of said prongs at one of said cross-over locations.

3. A device according to claim 2, wherein a portion of the guidance channel segment is disposed ahead of said locking member as viewed in the direction of motion of the intermediate members, said portion having a length approximately equal to the length of one of the intermediate members.

4. A device according to claim 1, wherein said positioning means is a prepositioning means adjoining said supply storage means and having a width in one dimension almost up to the height of one of the intermediate members, said prepositioning means changing over into said guidance channel and having a height and width corresponding to the height and width of one of the intermediate members, respectively, and being formed with an entrance opening, and further comprising a guidance rail disposed therein centrally and adjacent to said entrance opening.

5. A device according to claim 4, wherein said guidance rail extends only within an initial section of said guidance channel.

6. A device according to claim 1, further comprising a displaceable member attached to said frame and shiftable transversly between first and second rest positions, said displaceable member carrying said prongs and said supply member, said supply member and said handle portion having a plurality of guidance-channel segments, each of the supply-member guidance-channel segments being aligned with one of the handle-portion guidance-channel segments, and two of the handle-portion guidance-channel segments being adjacent to one another.

7. A device according to claim 6, wherein said handle portion has a plurality of guidance-channel segments disposed one above another, said supply member having first, second and third positions and being shiftable into said third position, said third position being disposed between said first and second positions, the upper of the handle-portion guidance segments communiating with one of said handle-portion guidance-channel segments, the lower of the handle-portion guidance-channel segments communiating with the other of said handle-portion guidance-channel segments in said first position.

8. A device according to claim 1, wherein said handle portion is coaxially rotatable within said frame, said frame having a longitudinal axis, and wherein said supply-storage means is formed within said rotatable handle portion, and wherein the latter is formed with a plurality of sorting channels in parallel with said axis and disposed on an inner periphery of said handle, said sorting channels communicating with said supply-storage means, said rotatable handle portion having a plurality of angular positions alignable with said sorting channels, respectively.

9. A device according to claim 8, wherein correctly and incorrectly positioned intermediate members are passable through said sorting channels and further comprising a plurality of helicoidally-shaped sorting channels, each of said helicoidally-shaped sorting channels having a central axis coinciding with said longitudinal axis, switching means for placing the sorting-channel passed correctly positioned intermediate members through said helicoidally-shaped sorting channels, and first and second separate channels for placing the correctly positioned intermediate members passed through the helicoidally-shaped sorting channels and the sorting-channel passed incorrectly positioned intermediate members into said first and second separate channels, respectively.

10. A device according to claim 9, wherein said switching means has inner and outer peripheries and a cross-section having approximately one and one half times the height of the height of each of said intermediate member, and a width equal to the width of each of said intermediate members, said switching means being formed with first and second guide rails disposed centrally on said inner and outer peripheries, respectively, said second guide rail communicating with one of said helicoidally-shaped sorting channels.

11. A device according to claim 8, further comprising an extension portion positively coupled to said handle portion and coaxially projecting into said frame, said sorting channels extending into said extension portion.

12. A device according to claim 11, wherein said extension portion has an outer periphery and said sorting channels are recesses formed on said outer periphery, the outer periphery of said extension portion being in slidable contact with said frame.

13. A device according to claim 8, further comprising a reinforcement rail attached to the outer side of said frame and being connected to said handle portion at a connecting location, said reinforcement rail projecting beyond said connecting location and abuttingly protecting the latter from snapping.

14. A device according to claim 8, wherein said rotatable handle is formed with a ring-shaped prepositioning region being narrow with respect to said supply-storage means and communicating with the latter, the radial width of said prepositioning region corresponding to the height of each of said intermediate members above a first plane parallel to a second plane, said second plane being substantially defined by said strings following insertion of said intermediate members between said strings, respectively.

15. A device according to claim 8, further comprising an externally actuable mixing mechanism having a plurality of wings and being coaxially disposed in said supply-storage means, said sorting channels being formed with respective entrance openings, said wings being brushable over said entrance openings.

16. A device according to claim 15, further comprising a cover seatable on said handle portion for closing off said supply-storage means, said cover being rigid with said mixing mechanism.

17. A device according to claim 16, wherein each of said sorting channels has a cross-section having a height and a width corresponding to the height and width of each of said intermediate members, respectively, said sorting channels having end portions adjacent to said entrance openings, and further comprising a plurality of guidance rails, said guidance rails being disposed at least in said end portions, respectively, each of said sorting channels having an outer periphery, said of said guidance rails being disposed on said outer periphery, whereby only correctly positioned intermediate members are insertable into said sorting channels.

18. A device according to claim 17, wherein said ring-shaped prepositioning region has a floor in communication with said sorting channels and is formed with at least one embossed portion.

19. A device according to claim 18, wherein said cover and said handle portion include first and second stops limiting the rotation of said mixing mechanism for preventing the wings of said mixing mechanism from impinging on said embossed portion.

20. A device according to claim 18, wherein said handle portion and said mixing mechanism include first and third stops limiting the rotation of the latter for preventing the wings of said mixing mechanism from impinging on said embossed portion.

21. A device according to claim 15, wherein each of said sorting channels is formed with a cross-section having a height and width corresponding to the height and width of each of said intermediate members, respectively, said sorting channels having end portions adjacent to said entrance openings, respectively, and further comprising a plurality of guidance rails, said guidance rails being disposed at least in said end portions, respectively, said guidance rails and said sorting channels comprising first and second groups, respectively, each of said sorting channels having inner and outer peripheries, the first and second guidance rail groups being centrally disposed on said outer and inner peripheries, respectively, whereby only correctly and incorrectly positioned intermeidate members are insertable into said first and second sorting channel groups, respectively.

22. A device according to claim 21, wherein said first and second sorting channel groups alternate with one another on the periphery of said handle portion.

23. A device according to claim 21, further comprising a feedback channel formed centrally within said device, and communicating with said supply-storage means, said second group of sorting channels communicating in a radially inward direction with said feedback channel.

24. A device according to claim 10, wherein each of the intermediate members has a longitudinal axis and wherein said second group of sorting channels is formed with a through-going bore, is alignable with said guidance channel and includes a turning segment for turning each of the intermediate members by 180° about the longitudinal axis thereof, the longitudinal axis of each of the intermediate members being parallel to the longitudinal axis of said frame, each of said sorting channels having inner and outer peripheries, one of said guide rails proceeding helicoidally from the inner periphery of a corresponding one of said sorting channels to the outer periphery thereof.

25. A device according to claim 10, wherein said second group of sorting channels are blind channels.

* * * * *